United States Patent [19]

Yamamoto et al.

[11] 4,420,445

[45] Dec. 13, 1983

[54] COAL PELLETS PRODUCTION

[75] Inventors: Sueshi Yamamoto, Tokyo; Kenichi Nagata, Yachiyo; Jisaku Tanimichi, Yokohama; Yoshiharu Takebe, Tokyo, all of Japan

[73] Assignee: Mitsui Engineering & Shipbuilding Co., Ltd., Tokyo, Japan

[21] Appl. No.: 337,169

[22] Filed: Jan. 5, 1982

[30] Foreign Application Priority Data

Jul. 10, 1980 [JP] Japan ..... 54-94155

[51] Int. Cl.[3] ..... B01J 2/12

[52] U.S. Cl. ..... 264/40.4; 264/117

[58] Field of Search ..... 264/40.4, 117

[56] References Cited

U.S. PATENT DOCUMENTS 3,366,717 1/1968 Rohaus ..... 264/117

3,562,783 2/1971 Gorin ..... 264/117

3,969,103 7/1976 Capes et al. ..... 264/117

4,219,519 8/1980 Goksel ..... 264/117

*Primary Examiner*—James R. Hall

*Attorney, Agent, or Firm*—Armstrong, Nikaido, Marmelstein & Kubovcik

[57] ABSTRACT

Disclosed is a method for the production of coal pellets for the penetration of finely pulverized coal particles suitable for combustion in a coal burner, which comprises the steps of milling raw coal, preparing a coal particle mixture comprising coarser particles and finer particles of the milled raw coal, and adding a binder to the coal particle mixture to produce coal pellets having the coarser coal particles as nuclei and the finer coal particles attached around the nuclei; the coal pellets so-obtained may be pulverized to provide finely divided coal particles.

2 Claims, 8 Drawing Figures

COAL PELLETS PRODUCTION

BACKGROUND OF THE INVENTION

The present invention relates to a method for producing coal pellets and, more particularly, a method for producing coal pellets to be used as fuel, which can be pneumatically transported and burnt in a coal burner of a boiler or the like.

Conventionally, fuel coal pellets have been prepared by adding a binder comprising a heavy oil, tar or pitch (hereinafter simply referred to as heavy oil or oil) to pulverized coal particles. Coal pellets so-produced appear to be dry solid particles but, in reality, have relatively high adhesion. When these fuel coal pellets are pulverized in a mill and then supplied by a pneumatic transport to, for example, a coal burner of a boiler, they have a strong tendency to attach and accumulate on the inner wall surface of the mill and the pneumatic transport pipe. As the operation time lapses, they undergo growing accumulation, so as to eventually clog the flow path in the operation machinery, resulting in that the intended burning can no longer continue. This also results in gradual lowering of the pulverization power of the mill, so that the mill eventually cannot produce the prescribed yield of pulverized coal particles.

As a result of extensive analytical studies of the above-discussed difficulties in the art, the present inventors discovered the following:

(1) In conventional coal-pellets production, the oil binder component was used in excessive amounts. In particular, according to conventional production methods, no consideration was given the fact that the product coal pellets are further processed for pulverization, and thereafter, pneumatically transported so as to be burnt in a coal burner. Also, in the conventional production of coal pellets, attention was only paid to such factors as the ease of pelletizing (generally speaking, the use of more oil component resulted in a greater ease of pelletizing). Thus, the above-discussed problem of adhesion of the coal particles was created as a matter of course.

(2) According to conventional methods, the oil component is used in an excessive amount, resulting in the product coal pellets lacking a desirable grindability. Namely, when conventional coal pellets have been pulverized, oil films were formed on the surface of the resultant coal particles, which provides a cushioning function. This adversely affects the transmission of a pulverization load onto the coal pellets, so that pulverization cannot effectively proceed.

In order to avoid the above-discussed difficulties, reduction of the amount of the oil binder used in the production of coal pellets was attempted. To this end, small scale tests were conducted using a relatively small amount of raw coal, and attempts were made to determine a minimum amount of the oil component required for production of coal pellets and, based on the data obtained, determine the preferred use amount of the oil component for an industrial scale of coal pellet production.

As a result of the above, the following facts are uncovered:

That the amount of the oil component required for the pelletizing is variable according to a change in the rank of coalification, ash content and water content in or of the material or raw coal, That raw coal products of a same place of origin and a same brand have varied properties depending upon a change in the bed depth where they were produced, and accordingly, they require varied amounts of the oil component for their pelletizing, That in handling an enormous volume of coal over a relatively great length of time, as is normally the case with the coal handling, physical properties of the coal surfaces, such as for example convexo-concave surface conditions, the size and distribution of capillary voids and ash contents of coal can change lot by lot and/or as time lapses, and That data as obtained above as a result of small scale test are not applicable to operations in an industrial scale plant and that only by way of suppressing the use amount of the oil component, it is feasible to provide a solution to the problems and difficulties discussed in the aforementioned passages (1) and (2).

SUMMARY OF THE INVENTION

The present invention has been derived as a result of the above-mentioned analytical studies carried out with the view of obviating the above-discussed problems with the present state of the art. According to the present invention, it is possible to essentially obviate the existing problems by controlling, mainly from the standpoint of the grindability of coal pellets, the distribution of coarser and finer member particles of the coal pellet and the formation of the oil film in association with the above distribution of member particles.

Thus, it is a first object of the present invention to provide a method for the production of coal pellets which can be pulverized through a pulverizer and pneumatically transported to a coal burner of, for example, a boiler, without any deposition and accumulation on wall surfaces of the pulverizer and the pneumatic transport machinery.

A second object of the invention is to provide a method for the production of coal pellets which are suitable for use as a fuel in coal-burner boilers or the like.

A third object of the invention is to provide a method for the production of coal pellets which have a high grindability through a pulverizer and do not contain excessive amounts of oil component therein.

A fourth object of the invention is to provide a method for the production of pulverized fuel coal pellets, which method is effectively applicable to all types of coal, regardless of a change with respect to the rank of coalification, place of origin, and bed depth of the raw coal.

A fifth object of the invention is to provide a method for the production of pulverized fuel coal pellets, with which a stable continuous combustion can be carried out.

A sixth object of the invention is to provide a method for the production of fuel coal pellets which is economical wherein the amount of a binder used; that is, the oil component; is suppressed to minimum.

The foregoing and other objects of the present invention, which will be apparent by the following description, are attained by providing a method which comprises preparing a coal mixture comprising crushed and/or pulverized coarser and finer coal particles, and adding a binder to this coal mixture, so as to produce coal pellets having the coarser coal particles as pellet nuclei and the finer coal particles attached about the peripheral surfaces of the nuclei.

The method of the present invention can reduce the amount of the oil component used for the production of coal pellets to a minimum, regardless of a change in the place of origin, rank of coalification and so forth of raw coal, as well as improve the grindability of the coal pellets and eliminate or remarkably suppress the problem of coal dust accumulating on wall surfaces of machinery involved in the method.

DETAILED DESCRIPTION OF THE PREFERRED EMBODIMENTS

For a better understanding of the present invention, a brief explanation will be initially set forth in connection with coal pellets produced according to conventional methods of pelletizing.

Figure 1:
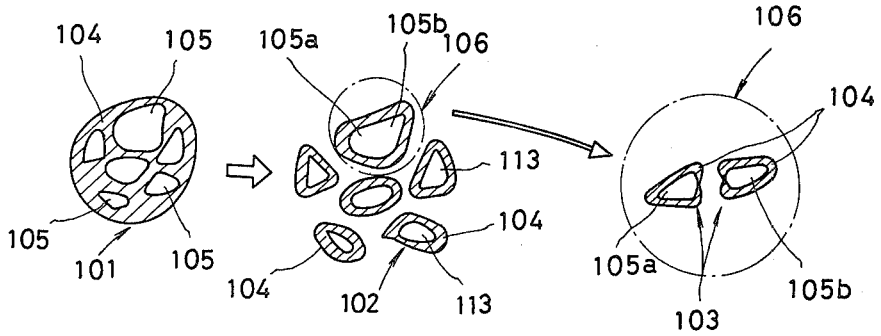
FIG.1 PRIOR ART
FIG. 1 is a schematic sectional view illustrating a manner in which a conventionally produced coal pellet is pulverized.

Thus, in FIG. 1, there is shown a coal pellet 101 according to the prior art, which is composed of member particles 105 and an oil film 104 binding the coal particles 105 together into the unitary pellet 101. It will be readily observed that the member particles 105 widely vary in particle size and that oil film 104 is relatively thick and comprises widely varied thickness portions. Accordingly, when pellet 101 is pulverized to finer particles 102 and coarser particles 106, particles 113 result which are wholly covered with oil films 104. Further, the coarser particle 106 may be further divided to particles 103, but a majority of their surface areas are still covered with an oil film 104 as represented by particles 105*a* and 105*b*. Accordingly, pulverized particles 113, 105*a* and 105*b* are rich in adhesion, and as a natural consequence of this, the previously discussed problems in the pulverization step and pneumatic transport occur.

According to the present invention, raw coal is initially crushed and/or pulverized to coarser and finer coal particles, of which a mixture is then prepared; and then, a binder is added to the coal particle mixture, to produce coal pellets.

Figure 2:
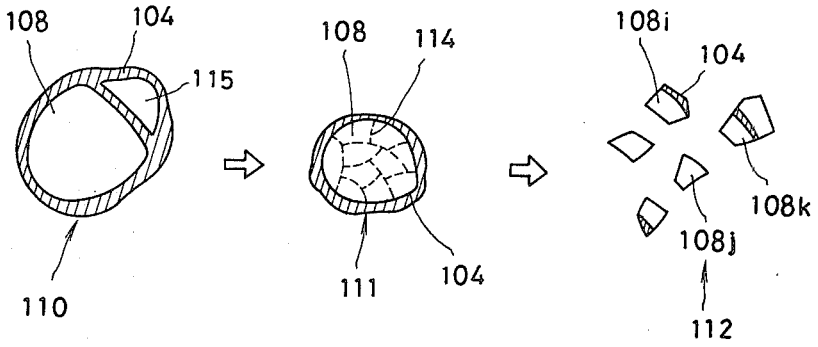
FIG. 2 similarly shows a schematic sectional view, illustrating the basic concept of the present invention and a manner in which a coal pellet is prepared in accord with the present invention is pulverized.

As shown in FIG. 2, a pellet 110 according to the present invention intentionally comprises a coarser particle 108 and a finer particle 115, which are covered with the oil film 104. The pellet 110 may be pulverized through a mill or pulverizer, whereby the coarser particle 108 becomes finely divided along crushing faces 114 to provide pulverized particles 112. In this case, although the oil film 104 is still present, divided particles 108*i* and 108*k* result which have the oil film 104 only in a portion of their entire surfaces and also such particles 108*j* result which are completely devoid of the oil film. Thus, the pulverized particles 112 according to the present invention exhibit no adhesion or little adhesion, and therefore, can be pneumatically transported into a boiler furnace or the like without fail and without the previously discussed difficulties.

As illustrated in FIG. 2 and described above in conjunction with FIG. 2, the method according to the present invention is essentially characterized in that it purposefully produces coal pellets from coarser particles and finer particles. In greater detail, the coal pellets made according to the present invention are characterized in that the composition of material coal particles employed for producing the coal pellets comprises a coarser particle component having maximum particle size within a range of from 3 to 7 mm and a finer particle component having maximum particle size below 0.5 mm inclusive.

When coarser particles having a maximum particle size smaller than 3 mm are used, it is difficult to obtain pulverized particles free of adhesion, as described above in conjunction with the illustration in FIG. 2. When coarser particles having a maximum particle size exceeding 7 mm are used, the product yield is conspicuously lowered and the strength of pellets also is lowered to such a degree that the products are easily prone to break, when they are subjected to falling impact during transportation and/or cargo handling.

According to the present invention, coarser particles and finer particles are mixed at a ratio normally of 50 to 75% by weight of the former to 50 to 25% by weight of the latter and, more preferably, 60 to 70% by weight of the former to 40 to 30% by weight of the latter.

When particle sizes of coarser and finer coal particles fall within the ranges recited above, the specific surface area ($m^2/g$) can be of a small value and the amount of an oil used in the pellet production can be as small as 1 to 8% based on the weight of coal to be pelletized.

The degree at which the coal pellets are pulverized may be of any value, inasmuch as the pulverized particles can be effectively transported through a pneumatic system. Generally, this degree may be such that 70 to 90% of pulverized particles can pass through a 200 mesh (74 microns) screen.

Figure 3:
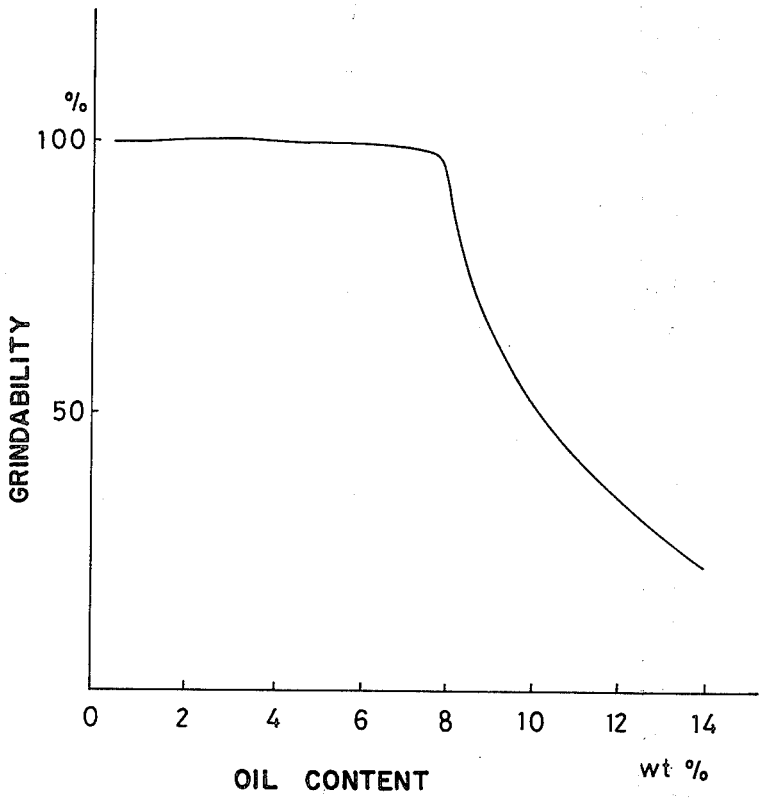
FIG. 3 is a graph, showing the relationship between the oil content in coal pellets and the grindability thereof.

FIG. 3 shows the relationship between the oil content (wt. %) in coal pellets and the grindability of coal pellets, wherein the coal pellets to be pulverized obtain a passage amount of 70–90% through 200 mesh. The data shown in FIG. 3 are obtained in connection with coal particles lying within the aforementioned ranges of particles lying within the aforementioned ranges of particle sizes and mixing range of coarser and finer particles.

According to the present invention, it is advantageous and preferred to effectively control the amount of the binder based on the yield values found by measuring the yield of pellet product. Similarly, by determining values for the grindability of the pellets to be pulverized through a mill, the composition of coarser and finer particles in the pellets can be controlled.

Now, the present invention will be described in greater detail in connection with illustrated embodiments thereof.

Figure 4:
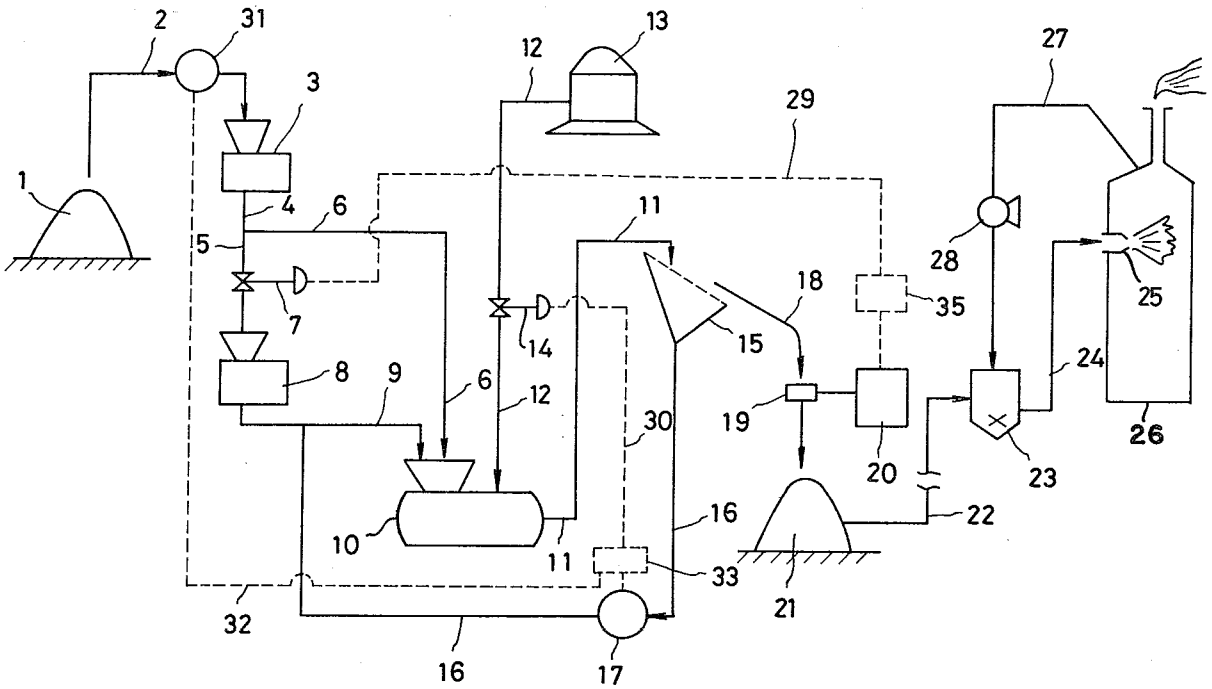
FIG. 4 shows a flow chart, showing steps in the method of a first embodiment of the present invention.

Initially, in FIG. 4, which represents a first embodiment of the method of the present invention, the raw coal 1 is crushed by a crusher 3 and pulverized by a first pulverizer 8, and then charged in a pelletizer 10 to obtain a coal pellet product 21, which is passed on and along a sieve or screen device 15 to undergo an inspection and is then temporarily stored in a storage lot.

By means of a suitable conveyor means 22, the coal pellets 21 are conveyed from the storage lot and charged in a second pulverizer 23. The resultant finely pulverized coal particles in pulverizer 23 are maintained in an air drifting condition by hot air supplied through pipe 27 communicating with air blower 28, so that they are supplied to coal burner 25 of boiler 26 through a pneumatic transport pipe 24 for combustion in the burner.

In further detail, the raw coal 1 is carried by a normally employed conveying means, for example a belt conveyor 2, so as to be charged into the crusher 3, by which there is obtained a coal particle flow in conveyor or pipeline 4 having coarser coal particles of a particle size within the previously recited range. The belt conveyor 2 is equipped with a mass flowmeter 31, which may be a belt scale for example, and values determined by the meter 31 are transmitted through a signal via wire 32 to a controller 33.

Coarser particles in conveyor 4 exiting from the crusher 3 are divided into two portions, and a first portion thereof is supplied through conveyor or pipeline 5 and variable flow rate device 7, for example a screw feeder of a variable rotation number type, into the first pulverizer 8. Pulverized finer coal particles, which have a particle size within the previously recited preferred range, are sent from the pulverizer 8 into the pelletizer 10 through a conveyor or pipeline 9.

The above-mentioned variable flow rate device 7 is structured so as to be responsive to signals transmitted through wire 29 by a controller 35, so that the mixing ratio or composition of coarser particles and finer particles can be suitably adjusted for the production of pellets.

The other of the two divided portions of coarser coal particles in conveyor 4 from the crusher 3 is delivered through a conveyor or pipeline 6 directly into the pelletizer 10. A heavy oil, that is, a binder received in a tank 13 is also suplied through a pipe 12 into pelletizer 10. The pellet product 21 is produced in pelletizer 10 and comprises coarser coal particles as the nucleus of the pellet and finer coal particles attached around the coarser particle nuclei.

The binder may comprise an emulsion mixture comprising a heavy oil with water and an emulsifier added thereto. An adjuvant, for example a nonion surfactant may also be added to the heavy oil. In this connection, it is preferred that water is added in an amount substantially corresponding to the amount of oil, and that the amount of additional additives are preferably added within a range of 0.1 to 0.5% based on the weight of coal.

The above recited pipe 12 from the oil tank 13 is provided in an intermediate point of its full extension with a flow rate control valve 14, which is operated to open and close by signals sent via wire 30 from the controller 33, so that the amount of the binder incorporated can be controlled.

The coal pellet products from the pelletizer 10 are sent through conveyor or pipeline 11 and discharged over sieve 15, which may comprise for example an inclined wire screen device.

Matters falling through the sieve 15, which comprise finely sized coal pellets 21 and coal dusts which are not pelletized, are recycled through conveyor or pipeline 16 to the conveyor 9 extended from the discharge side of the pulverizer. The conveyor 16 has a mass flow meter 17 disposed in an intermediate point thereof, and data detected by the flow meter 17 are encoded and transmitted to the controller 33.

Matters recovered on the sieve 15, namely coal pellets 21, are carried by for example a belt conveyor 18 to the storage site and collected therein. The belt conveyor 18 intermediately incorporates an automatic sampler 19, by which samples of the pellet products 21 are taken for a grindability value determination by a tester 20.

The grindability tester 20 may suitably comprise an automated device of the Hardgrove grindability indexing instrument complying with ASTM D409-71, and the data found through such tester are transmitted to the controller 35.

Figure 5:
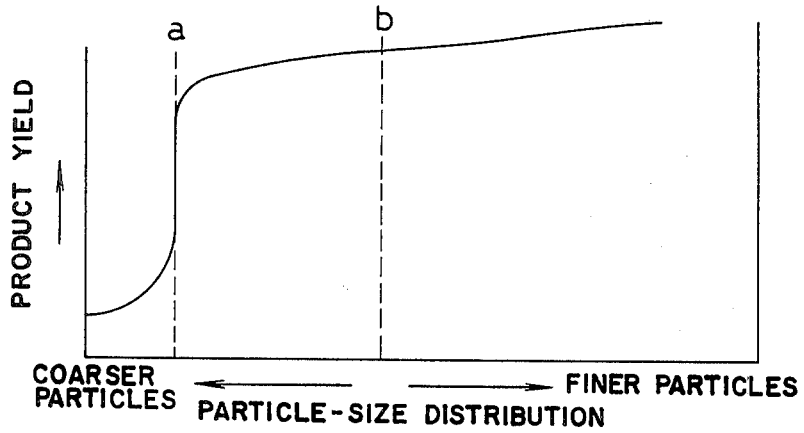
FIG. 5 is a graph, showing the relationship between the composition of coarser and finer coal particles in coal pellets and the product yield.
Figure 6:
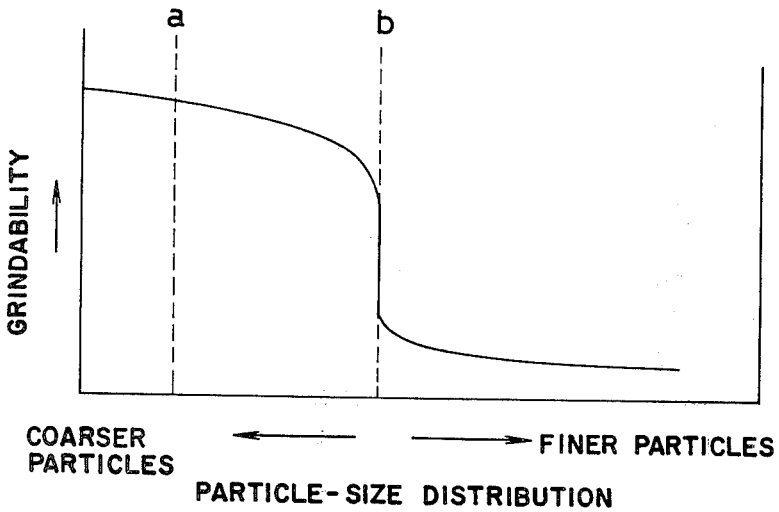
FIG. 6 also is a graph, showing the relationship between the composition of coarser and finer coal particles in coal pellets and the grindability of the coal pellets.
Figure 7:
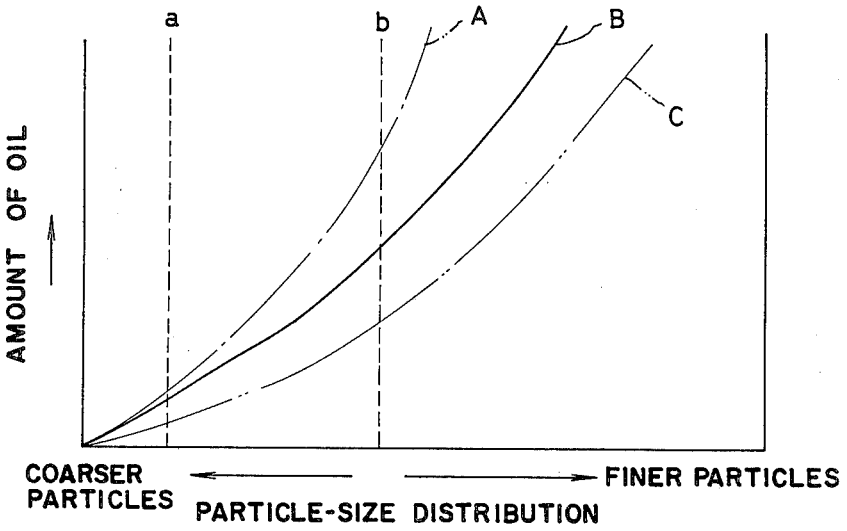
FIG. 7 also shows a diagrammatic view or graph, illustrating the relationship between the composition of coarser and finer particles in coal pellets and the amount of a heavy oil used in connection with raw coal products of different qualities or properties.

FIGS. 5, 6 and 7 illustrate the influences of a change in the composition of coarser and finer particles of coal supplied to the pelletizer on the pelletizing performance.

By operating the variable flow rate device 7, the above-mentioned composition is adjusted, which may otherwise be termed the distribution of coal particles of coarser and finer sizes. For instance, when the device 7 is completely closed, coarser particles alone are received in the pelletizer 10.

Common to all graphs of FIGS. 5, 6 and 7 is the composition or distribution of diferent size particles, namely, the left end of the abscissa of the graphs comprises wholly coarser particles, while the right end comprises wholly finer particles. Operating the device 7 varies the composition represented on the abscissas of the graphs.

The curve line depicted in FIG. 5 represents the yield of product pellets, and that shown in FIG. 6 represents grindability indices. Control operations effected according to the present invention are based on the functional relationship between these factors. Further, shown in FIG. 7 are the amounts of the oil, required.

The control according to the method of the present invention for providing a high product yield is effected by measuring the amount of raw coal 1 being charged through the mass flow meter 31, by measuring the flow amount of fine coal particles which were not pelletized and which have fallen through the sieve 15 charged through the flow meter 17, and by determining the difference between the two measured amounts in controller 33. Based on the data found by the controller 33, the flow rate control valve 14 is operated to open or close so as to maintain the yield of product pellets 21 above the prescribed set value. For example, an increase in the amount of fine particles not pelletized which fall through the sieve 15 means an insufficient supply of the oil, and in this case, the valve 14 may be opened so as to supply more oil. By operating as above, it is feasible to maintain product yields within a range lying right of the boundary a in FIG. 5.

The control for providing a desirable grindability value is effected by the operation of the automatic sampler 19 and the grindability tester 20 through which the grindability values of product pellets 21 are determined. The data for the grindability values are evaluated by controller 35, which supplies a signal via wire 29 to variable flow rate device 7; thereby, making it feasible to modify the composition or distribution of coarser and finer coal particles charged into the pelletizer 10. Thus, it is possible to obtain pellets having grindability values within a range lying left of the boundary b in FIG. 7.

In greater detail, for example, when pellets are found to possess a lowered grindability, the variable flow rate device 7 may be operated towards the closed position, which increases the amount of coarser particles, whereby the grindability can be raised.

By the above-described control operations, pelletizing can be carried out in the ranges lying between boundaries a and b, in FIGS. 5 and 6, whereby objects of the present invention can be effectively brought about.

Generally, the condition of coal particle surface and the corresponding amount of binder required vary by brand of raw coal material, depending upon a charge in the bed depth where the coal material was produced. This is shown in FIG. 7 in connection with raw coal products A (coal of a low coalification rank such as brown coal), B (subbituminous coal) and C (bituminous coal). Thus, only by way of controlling the amount of a heavy oil supplied, it is feasible to effectively control the adhesion and the grindability of coal pellets.

According to the present invention, however, influences resulting from a change in the coal quality are effectively removed or suppressed as illustrated in FIGS. 5 and 6, and therefore, the present invention can provide considerable advantages over conventional art.

Figure 8:
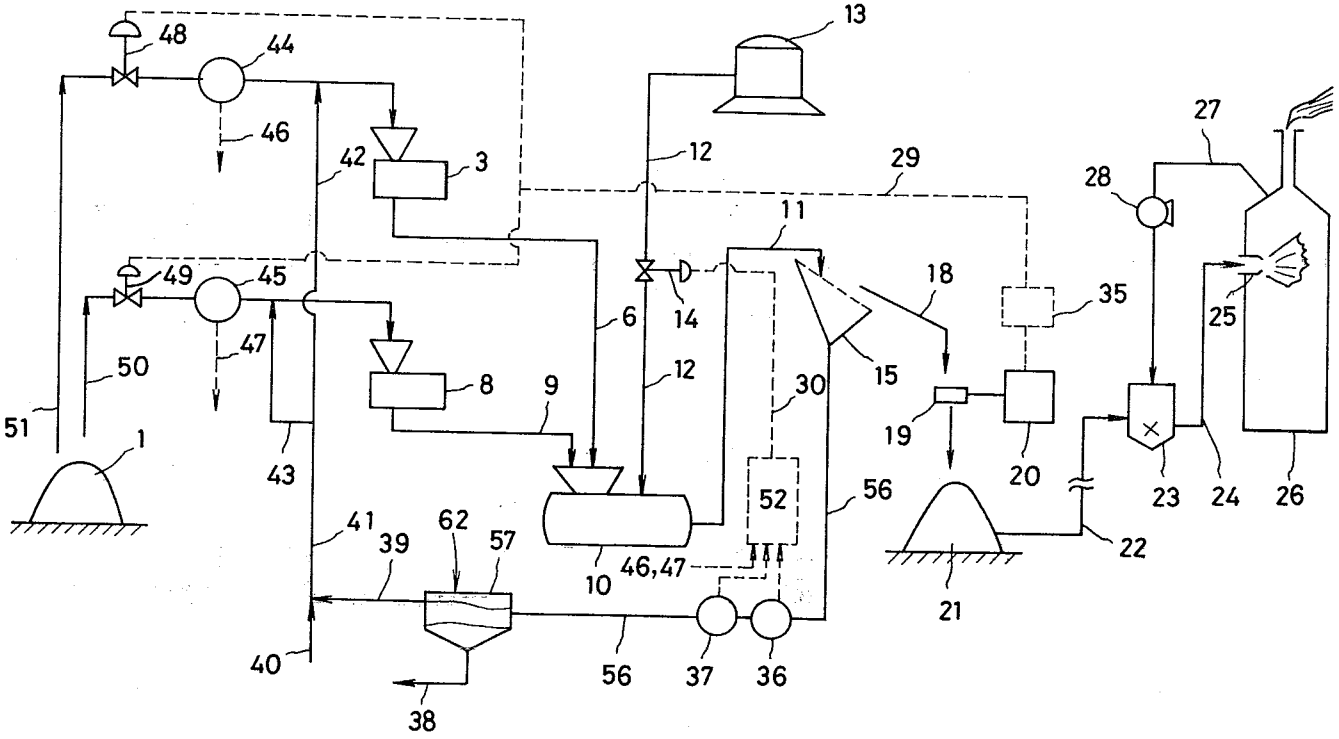
FIG. 8 is a similar view to FIG. 4 and illustrates steps in the method according to a second embodiment of the present invention.

A second embodiment of the invention is illustrated in FIG. 8, the raw coal 1 is mixed with water to provide a slurry, which is supplied into the pelletizer 10. In this case, pelletizer 10 is a wet-type one. With the exception that each conveyor or pipeline for coal particles or coal pellets in the system shown in FIG. 4 is provided for a slurry comprising a mixture of coal particles and water, the method of FIG. 8 is in principle identical with the method of the foregoing described first embodiment.

Raw coal 1 is supplied to the crusher 3 through conveyor or pipeline 51, a variable flow rate device 48 and a flow meter 44; the resultant raw coal 1 is then mixed with water supplied through a pipe 42 to provide a slurry.

The crusher 3 is of the wet-type; and the product therefrom, which is in a slurry state, is supplied into a wet-type pelletizer 10.

Data measured through the flow meter 44 are transmitted by signals through a wire 46 to a control device 52. Further, the variable flow rate device 48 is operated by signals sent via wire 29 from a controller 35.

The raw coal 1 is also delivered through a conveyor or flow pipeline 50, a variable flow rate device 49 and a flow meter 45. Thereafter, it is mixed with water supplied by way of a pipe 43, and then it is charged into a wet-type mill 8 in the form of a slurry.

Measured values through the flow meter 45 are transmitted by signals via wire 47 to the control device 52, and the variable flow rate device 49 is responsive to signals transmitted via wire 29 from the controller 35.

Pellet products from the pelletizer 10 are removed through conveyor or pipeline 11 in a slurry state and discharged over a sieve or screen device 15, from which fine pellet portions and such coal particles which are yet to be pelletized are permitted to fall into a pipe 56 and through this pipe 56, they are sent into a separator 57.

The above recited pipe 56 is intermediately equipped with a slurry flow meter 36 comprising for example an electromagnetic flow meter and also a $\gamma$-ray densitometer 37. Data measured through the meters 36 and 37 are supplied to the control device 52.

For simplicity sake, the separator 57 may comprise a thickener, in which a coagulant is added so as to have the ash components precipitate and discharge through a pipe 38, and from which the supernatant is sent through pipes 39, 41, 42 and 43 and recycled.

The replenishing of water may be effected in connection with any of the above recited pipes, for example, it may be supplied into the pipe 41 through a pipe 40 communicated with a suitable water source (not shown).

In the separator 57, an ash component contained in the material coal or raw coal 1, together with fine pelletized particles and yet-pelletized coal particles, may possibly be received; but such ash content may be effectively separated by incorporating therein a suitable selective coagulant. This may be accomplished for example, by incorporating an appreciable amount of oil together with the coagulant 62; or by such method wherein the ash contents alone are removed, which is highly advantageously employed in accord with the present invention.

In operating the control, values obtained in flow meters 44 and 45 may be supplied to control device 52 to obtain the total amount of the supplied coal 1. The amount of yet pelletized coal particles is obtained from the product of the values found through electromagnetic flow meter 36 and $\gamma$-ray densitometer 37. The yield of product pellets may then be obtained based on the difference of the above obtained values for the amounts of the supplied coal and of the yet pelletized coal particles. Further, the above obtained values of the product yield may be supplied for comparison with the predetermined set value to control the amount of the heavy oil supplied by way of opening or closing a flow rate control value 14.

Data for grindability values are fed to controller 35, which is adapted to operate a control such that, for example, when a lowering or raising of the grindability is detected, it functions to open and close variable flow rate devices 48 and 49, respectively.

The above control operations are in principle the same as those in the case of the above-described first embodiment.

Although the present invention is described in the foregoing with a single step pelletizing such as illustrated in FIGS. 4 and 8, it will readily be understood by those skilled in the art that the pelletizer 10 may comprise a two-stage pelletizer or that a first pelletizer may comprise a dry-type one, while a second pelletizer may comprise a wet-type one.

Further, whereas identical members or elements in FIGS. 4 and 8 are represented by identical reference characters, conveyor means 22 may include means for a long distance transportation, for example. a slurry transportation pipe means, ship transportation means and so forth.

As described above, according to the method of the present invention for the production of coal pellets, coal pellets, which are formed from coarser coal particles through a mill, the composition of coarser and finer particles in the pellets can be controlled.

Now, the present invention will be described in greater detail in connection with illustrated embodiments thereof.

Initially, in FIG. 4, which represents a first embodiment of the method of the present invention, the raw coal 1 is crushed by a crusher 3 and pulverized by a first pulverizer 8, and then charged in a pelletizer 10 to obtain a coal pellet product 21, which is passed on and along a sieve or screen device 15 to undergo an inspection and is then temporarily stored in a storage lot.

By means of a suitable conveyor means 22, the coal pellets 21 are conveyed from the storage lot and charged in a second pulverizer 23. The resultant finely pulverized coal particles in pulverizer 23 are maintained in an air drifting condition by hot air supplied through pipe 27 communicating with air blower 28, so that they are supplied to coal burner 25 of boiler 26 through a pneumatic transport pipe 24 for combustion in the burner.

In further detail, the raw coal 1 is carried by a normally employed conveying means, for example a belt conveyor 2, so as to be charged into the crusher 3, by which there is obtained a coal particle flow in conveyor or pipeline 4 having coarser coal particles of a particle size within the previously recited range. The belt conveyor 2 is equipped with a mass flowmeter 31, which may be a belt scale for example, and values determined by the meter 31 are transmitted through a signal via wire 32 to a controller 33.

Coarser particles in conveyor 4 exiting from the crusher 3 are divided into two portions, and a first portion thereof is supplied through conveyor or pipeline 5 and variable flow rate device 7, for example a screw feeder of a variable rotation number type, into the first pulverizer 8. Pulverized finer coal particles, which have a particle size within the previously recited preferred range, are sent from the pulverizer 8 into the pelletizer 10 through a conveyor or pipeline 9.

The above-mentioned variable flow rate device 7 is structured so as to be responsive to signals transmitted through wire 29 by a controller 35, so that the mixing ratio or composition of coarser particles and finer particles can be suitably adjusted for the production of pellets.

The other of the two divided portions of coarser coal particles in conveyor 4 from the crusher 3 is delivered through a conveyor or pipeline 6 directly into the pelletizer 10. A heavy oil, that is, a binder received in a tank 13 is also suplied through a pipe 12 into pelletizer 10. The pellet product 21 is produced in pelletizer 10 and comprises coarser coal particles as the nucleus of the pellet and finer coal particles attached around the coarser particle nuclei.

The binder may comprise an emulsion mixture comprising a heavy oil with water and an emulsifier added thereto. An adjuvant, for example a nonion surfactant may also be added to the heavy oil. In this connection, it is preferred that water is added in an amount substantially corresponding to the amount of oil, and that the amount of additional additives are preferably added within a range of 0.1 to 0.5% based on the weight of coal.

The above recited pipe 12 from the oil tank 13 is provided in an intermediate point of its full extension with a flow rate control valve 14, which is operated to open and close by signals sent via wire 30 from the controller 33, so that the amount of the binder incorporated can be controlled.

The coal pellet products from the pelletizer 10 are sent through conveyor or pipeline 11 and discharged over sieve 15, which may comprise for example an inclined wire screen device.

Matters falling through the sieve 15, which comprise finely sized coal pellets 21 and coal dusts which are not pelletized, are recycled through conveyor or pipeline 16 to the conveyor 9 extended from the discharge side of the pulverizer. The conveyor 16 has a mass flow meter 17 disposed in an intermediate point thereof, and data detected by the flow meter 17 are encoded and transmitted to the controller 33.

Matters recovered on the sieve 15, namely coal pellets 21, are carried by for example a belt conveyor 18 to the storage site and collected therein. The belt conveyor 18 intermediately incorporates an automatic sampler 19, by which samples of the pellet products 21 are taken for a grindability value determination by a tester 20.

The grindability tester 20 may suitably comprise an automated device of the Hardgrove grindability indexing instrument complying with ASTM D409-71, and the data found through such tester are transmitted to the controller 35.

FIGS. 5, 6 and 7 illustrate the influences of a change in the composition of coarser and finer particles of coal supplied to the pelletizer on the pelletizing performance.

By operating the variable flow rate device 7, the above-mentioned composition is adjusted, which may otherwise be termed the distribution of coal particles of coarser and finer sizes. For instance, when the device 7 is completely closed, coarser particles alone are received in the pelletizer 10.

Common to all graphs of FIGS. 5, 6 and 7 is the composition or distribution of diferent size particles, namely, the left end of the abscissa of the graphs comprises wholly coarser particles, while the right end comprises wholly finer particles. Operating the device 7 varies the composition represented on the abscissas of the graphs.

The curve line depicted in FIG. 5 represents the yield of product pellets, and that shown in FIG. 6 represents grindability indices. Control operations effected according to the present invention are based on the functional relationship between these factors. Further, shown in FIG. 7 are the amounts of the oil, required.

The control according to the method of the present invention for providing a high product yield is effected by measuring the amount of raw coal 1 being charged through the mass flow meter 31, by measuring the flow amount of fine coal particles which were not pelletized and which have fallen through the sieve 15 charged through the flow meter 17, and by determining the difference between the two measured amounts in controller 33. Based on the data found by the controller 33, the flow rate control valve 14 is operated to open or close so as to maintain the yield of product pellets 21 above the prescribed set value. For example, an increase in the amount of fine particles not pelletized which fall through the sieve 15 means an insufficient supply of the oil, and in this case, the valve 14 may be opened so as to supply more oil. By operating as above, it is feasible to maintain product yields within a range lying right of the boundary a in FIG. 5.

The control for providing a desirable grindability value is effected by the operation of the automatic sampler 19 and the grindability tester 20 through which the grindability values of product pellets 21 are determined. The data for the grindability values are evaluated by controller 35, which supplies a signal via wire 29 to variable flow rate device 7; thereby, making it feasible to modify the composition or distribution of coarser and finer coal particles charged into the pelletizer 10. Thus, it is possible to obtain pellets having grindability values within a range lying left of the boundary b in FIG. 7.

In greater detail, for example, when pellets are found to possess a lowered grindability, the variable flow rate device 7 may be operated towards the closed position, which increases the amount of coarser particles, whereby the grindability can be raised.

By the above-described control operations, pelletizing can be carried out in the ranges lying between boundaries a and b, in FIGS. 5 and 6, whereby objects of the present invention can be effectively brought about.

Generally, the condition of coal particle surface and the corresponding amount of binder required vary by brand of raw coal material, depending upon a charge in the bed depth where the coal material was produced. This is shown in FIG. 7 in connection with raw coal products A (coal of a low coalification rank such as brown coal), B (subbituminous coal) and C (bituminous coal). Thus, only by way of controlling the amount of a heavy oil supplied, it is feasible to effectively control the adhesion and the grindability of coal pellets.

According to the present invention, however, influences resulting from a change in the coal quality are effectively removed or suppressed as illustrated in FIGS. 5 and 6, and therefore, the present invention can provide considerable advantages over conventional art.

A second embodiment of the invention is illustrated in FIG. 8, the raw coal 1 is mixed with water to provide a slurry, which is supplied into the pelletizer 10. In this case, pelletizer 10 is a wet-type one. With the exception that each conveyor or pipeline for coal particles or coal pellets in the system shown in FIG. 4 is provided for a slurry comprising a mixture of coal particles and water, the method of FIG. 8 is in principle identical with the method of the foregoing described first embodiment.

Raw coal 1 is supplied to the crusher 3 through conveyor or pipeline 51, a variable flow rate device 48 and a flow meter 44; the resultant raw coal 1 is then mixed with water supplied through a pipe 42 to provide a slurry.

The crusher 3 is of the wet-type; and the product therefrom, which is in a slurry state, is supplied into a wet-type pelletizer 10.

Data measured through the flow meter 44 are transmitted by signals through a wire 46 to a control device 52. Further, the variable flow rate device 48 is operated by signals sent via wire 29 from a controller 35.

The raw coal 1 is also delivered through a conveyor or flow pipeline 50, a variable flow rate device 49 and a flow meter 45. Thereafter, it is mixed with water supplied by way of a pipe 43, and then it is charged into a wet-type mill 8 in the form of a slurry.

Measured values through the flow meter 45 are transmitted by signals via wire 47 to the control device 52, and the variable flow rate device 49 is responsive to signals transmitted via wire 29 from the controller 35.

Pellet products from the pelletizer 10 are removed through conveyor or pipeline 11 in a slurry state and discharged over a sieve or screen device 15, from which fine pellet portions and such coal particles which are yet to be pelletized are permitted to fall into a pipe 56 and through this pipe 56, they are sent into a separator 57.

The above recited pipe 56 is intermediately equipped with a slurry flow meter 36 comprising for example an electromagnetic flow meter and also a $\gamma$-ray densitometer 37. Data measured through the meters 36 and 37 are supplied to the control device 52.

For simplicity sake, the separator 57 may comprise a thickener, in which a coagulant is added so as to have the ash components precipitate and discharge through a pipe 38, and from which the supernatant is sent through pipes 39, 41, 42 and 43 and recycled.

The replenishing of water may be effected in connection with any of the above recited pipes, for example, it may be supplied into the pipe 41 through a pipe 40 communicated with a suitable water source (not shown).

In the separator 57, an ash component contained in the material coal or raw coal 1, together with fine pelletized particles and yet-pelletized coal particles, may possibly be received; but such ash content may be effectively separated by incorporating therein a suitable selective coagulant. This may be accomplished for example, by incorporating an appreciable amount of oil together with the coagulant 62; or by such method wherein the ash contents alone are removed, which is highly advantageously employed in accord with the present invention.

In operating the control, values obtained in flow meters 44 and 45 may be supplied to control device 52 to obtain the total amount of the supplied coal 1. The amount of yet pelletized coal particles is obtained from the product of the values found through electromagnetic flow meter 36 and $\gamma$-ray densitometer 37. The yield of product pellets may then be obtained based on the difference of the above obtained values for the amounts of the supplied coal and of the yet pelletized coal particles. Further, the above obtained values of the product yield may be supplied for comparison with the predetermined set value to control the amount of the heavy oil supplied by way of opening or closing a flow rate control value 14.

Data for grindability values are fed to controller 35, which is adapted to operate a control such that, for example, when a lowering or raising of the grindability is detected, it functions to open and close variable flow rate devices 48 and 49, respectively.

The above control operations are in principle the same as those in the case of the above-described first embodiment.

Although the present invention is described in the foregoing with a single step pelletizing such as illustrated in FIGS. 4 and 8, it will readily be understood by those skilled in the art that the pelletizer 10 may comprise a two-stage pelletizer or that a first pelletizer may comprise a dry-type one, while a second pelletizer may comprise a wet-type one.

Further, whereas identical members or elements in FIGS. 4 and 8 are represented by identical reference characters, conveyor means 22 may include means for a long distance transportation, for example. a slurry transportation pipe means, ship transportation means and so forth.

As described above, according to the method of the present invention for the production of coal pellets, coal pellets, which are formed from coarser coal particles and finer coal particles, are pulverized, so that coal particles can be formed which comprise those having only a portion of the surface area covered with an oil film and those which are completely devoid of an oil film. Thus, the coal pellets prepared according to the present invention are pulverized in preparation for their combustion in a burner and pneumatically transported into the burner. Since the pulverized coal pellets have a low content of, for example, a heavy oil, they are effectively prevented from becoming attached to the wall surface of the pneumatic transport pipe and from accumulating on the same wall surface clogging the transportation path. Also, with the product of the invention, a stable combustion is obtainable without fail. Besides, the coal pellets prepared according to the present invention exhibit a desirable grindability for processing by a pulverizer, and yet can be produced at a high yield.

Further, in the method of the present invention, it is possible to control the composition or distribution of coarser particles and finer particles of coal to be supplied into the pelletizer based on values determined of the grindability of pellets, whereby an advantage is brought about such that by automatic adjustment for a change in the coal quality, combustion can be stably carried out.

Furthermore, according to the invention, the production of finely divided coal particles can be carried out free of an influence from a change with respect to the rank of coalification of the raw coal, place of origin of the raw coal, bed depth where the raw coal was produced and so forth.

According to the described second embodiment of the invention in particular, an additional advantage is obtained such that by way of employing wet-type pelletizing, coal pellets devoid of ash contents are obtained, whereby transportation and combustion can be provided in a highly desirable manner.

What is claimed is:

1. A method of making fuel pellets from coal particles, comprising:

(a) milling raw coal to form a mixture of coal particles comprising:

1. 50–75 wt. % of coarse coal particles having a maximum particle size of 3–7 mm, and 2. 50–25 wt. % of fine coal particles having a maximum particle size of 0.5 mm, (b) introducing the mixture of coal particle sizes into a pelletizer.

(c) introducing into said mixture in said pelletizer a hydrocarbon oil binder for said coal particles, in an amount of 1–8 wt. % of said mixture, (d) treating said coal mixture and binder in said pelletizer to form coal pellets having said fine particles attached about the coarse particles, (e) measuring the yield of said coal pellets produced in said pelletizer, and controlling the amount of binder oil added to said mixture, based upon said measured pellet yield, and (f) measuring values for grindability of said produced coal pellets, and controlling the composition of said coarse and fine particles in said formed mixture in step (a) on the basis of said measured grindability values.

2. A method of making fuel pellets from coal particles, comprising:

(a) milling raw coal in the presence of water to form an aqueous slurry of a mixture of coal particles comprising:

1. 50–75 wt. % of coarse coal particles having a maximum particle size of 3–7 mm, and 2. 50–25 wt. % of fine coal particles having a maximum particle size of 0.5 mm, (b) introducing the mixture of coal particle sizes into a pelletizer, (c) introducing into said mixture in said pelletizer a hydrocarbon oil binder for said coal particles, in an amount of 1–8 wt. % of said mixture, (d) treating said coal mixture and binder in said pelletizer to form coal pellets having said fine particles attached about the coarse particles, (e) measuring the yield of said coal pellets produced in said pelletizer, and controlling the amount of binder oil added to said mixture, based upon said measured pellet yield, (f) measuring values for grindability of said produced coal pellets, and controlling the composition of said coarse and fine particles in said formed mixture in step (a) on the basis of said measured grindability values, and (g) removing said formed pellets from said water.

* * * * *